US010022003B1

(12) United States Patent
Edoria

(10) Patent No.: US 10,022,003 B1
(45) Date of Patent: Jul. 17, 2018

(54) PILLOW WITH AUDIBLE AND VIBRATORY ALARMS

(71) Applicant: Rogelio Edoria, Falling Waters, WV (US)

(72) Inventor: Rogelio Edoria, Falling Waters, WV (US)

( * ) Notice: Subject to any disclaimer, the term of this patent is extended or adjusted under 35 U.S.C. 154(b) by 50 days.

(21) Appl. No.: 15/351,487

(22) Filed: Nov. 15, 2016

(51) Int. Cl.

| | |
|---|---|
| ***A47G 9/10*** | (2006.01) |
| ***A47G 9/00*** | (2006.01) |
| ***G04B 25/02*** | (2006.01) |
| ***G04G 13/02*** | (2006.01) |

(52) U.S. Cl.
CPC ..... *A47G 9/1045* (2013.01); *A47G 9/007* (2013.01); *G04B 25/02* (2013.01); *G04G 13/021* (2013.01); *A47G 2009/006* (2013.01)

(58) Field of Classification Search
CPC ..... A47G 2009/006; A47G 9/1045; A47G 9/007; A47G 9/10
See application file for complete search history.

(56) References Cited

U.S. PATENT DOCUMENTS

| | | | | |
|---|---|---|---|---|
| 2,890,465 | A * | 6/1959 | Mira | A47G 9/1036 128/202.18 |
| 2,917,046 | A * | 12/1959 | Fairbanks | A61M 15/00 128/202.18 |
| 4,826,479 | A * | 5/1989 | Burgin | A47G 9/007 5/636 |
| 5,038,431 | A * | 8/1991 | Burgin | A47G 9/007 119/28.5 |
| 6,236,621 | B1 | 5/2001 | Schettino | |
| 7,578,013 | B2 * | 8/2009 | Aikman | A47C 20/021 340/573.1 |
| 7,627,917 | B2 | 12/2009 | Vandenbelt | |
| 8,056,167 | B2 | 11/2011 | Cheung et al. | |
| 8,127,384 | B2 | 3/2012 | Carlton | |
| 8,566,986 | B1 | 10/2013 | Chu | |
| 9,003,582 | B2 | 4/2015 | Armbruster | |
| 2004/0252847 | A1 | 12/2004 | Bassett | |
| 2012/0142999 | A1 * | 6/2012 | Albu | A47G 9/0215 600/26 |
| 2012/0209058 | A1 | 8/2012 | Arasi | |
| 2013/0043988 | A1 | 2/2013 | Bruno | |
| 2014/0053338 | A1 * | 2/2014 | White | A47G 9/1045 5/641 |
| 2014/0366273 | A1 | 12/2014 | Davis, II | |

* cited by examiner

*Primary Examiner* — Eric J Kurilla
(74) *Attorney, Agent, or Firm* — Kyle A. Fletcher, Esq.

(57) ABSTRACT

The pillow with audible and vibratory alarms is a pillow that includes a vibrating member integrated therein. The vibrating member is able to generate a vibratory alarm to awaken an end user. The pillow also includes a scent distribution system that is able to dispense a scent from a side of the pillow, which the end user is able to smell, and may be optionally used as a scent alarm. The pillow includes a speaker that is able to emit an audible alarm, which is optionally used to awaken the end user. The vibrating member, the speaker, and the scent distribution system are all collectively in wired connection with a control module. In use, the end user utilizes the pillow in a traditional manner, but is optionally awaken via an audible alarm, a vibratory alarm, and/or a scent alarm.

11 Claims, 3 Drawing Sheets

PILLOW WITH AUDIBLE AND VIBRATORY ALARMS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of bedding, more specifically, a pillow that includes an audible alarm as well as a vibratory alarm.

SUMMARY OF INVENTION

The pillow with audible and vibratory alarms is a pillow that includes a vibrating member integrated therein. The vibrating member is able to generate a vibratory alarm to awaken an end user. The pillow also includes a scent distribution system that is able to dispense a scent from a side of the pillow, which the end user is able to smell, and may be optionally used as a scent alarm. The pillow includes a speaker that is able to emit an audible alarm, which is optionally used to awaken the end user. The vibrating member, the speaker, and the scent distribution system are all collectively in wired connection with a control module. The control module is located adjacent to a control interface member that is provided on a second side of the pillow. In use, the end user utilizes the pillow in a traditional manner, but is optionally awaken via an audible alarm, a vibratory alarm, and/or a scent alarm.

It is an object of the invention to provide a pillow with a plurality of different alarm means integrated into the construction of the pillow.

An object of the invention is to provide a pillow with an audible alarm that is able to awaken the end user.

An object of the invention is to provide a pillow with a vibratory alarm that is able to awaken the end user.

An object of the invention is to provide a pillow with a scent alarm that is able to awaken the end user.

Another object of the invention is to provide a pillow where the speaker is used to play a calming, soothing, and relaxing audio file that aids in helping the end user to fall asleep.

Another object of the invention is to provide a transceiver that is used to retrieve an audio file from an electronic device wirelessly.

These together with additional objects, features and advantages of the pillow with audible and vibratory alarms will be readily apparent to those of ordinary skill in the art upon reading the following detailed description of the presently preferred, but nonetheless illustrative, embodiments when taken in conjunction with the accompanying drawings.

In this respect, before explaining the current embodiments of the pillow with audible and vibratory alarms in detail, it is to be understood that the pillow with audible and vibratory alarms is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pillow with audible and vibratory alarms.

It is therefore important that the claims be regarded as including such equivalent construction insofar as they do not depart from the spirit and scope of the pillow with audible and vibratory alarms. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
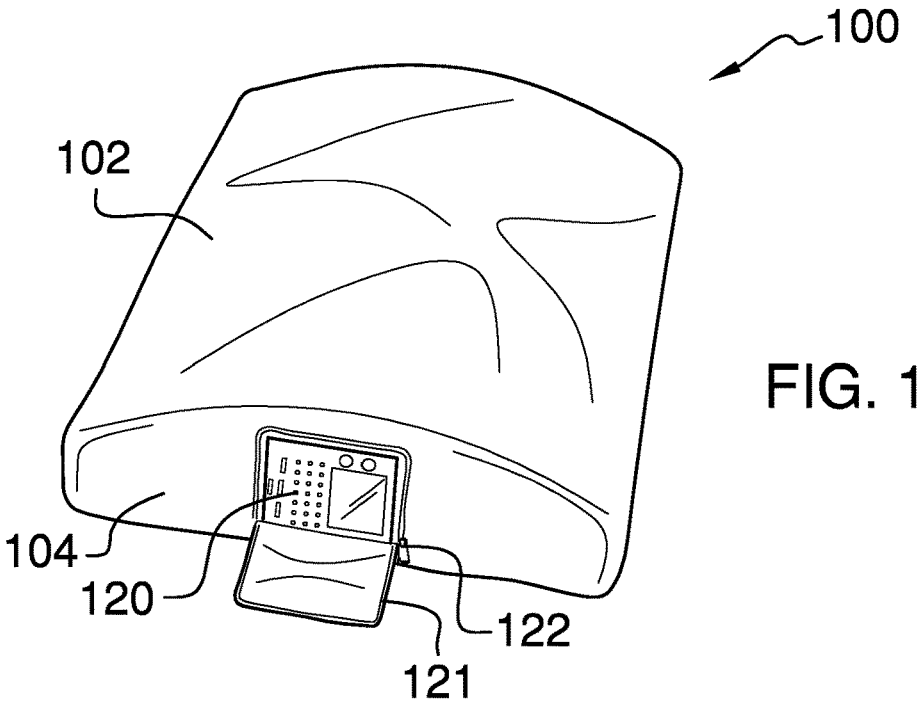
FIG. 1 is a side, perspective view of an embodiment of the disclosure.
Figure 2:
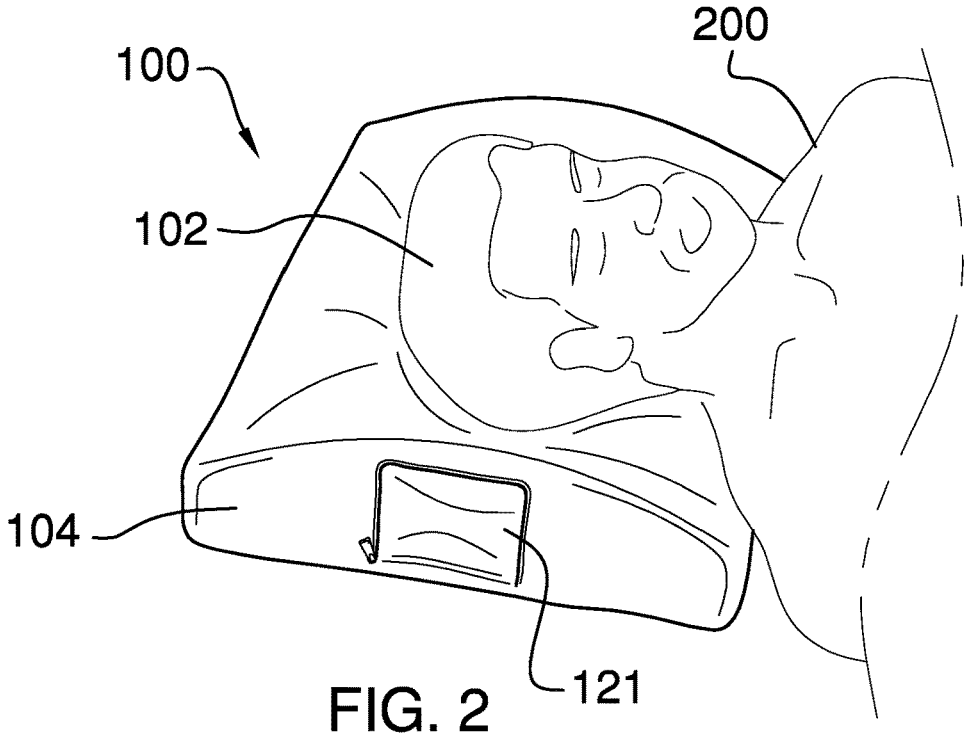
FIG. 2 is another side, perspective view of an embodiment of the disclosure.
Figure 3:
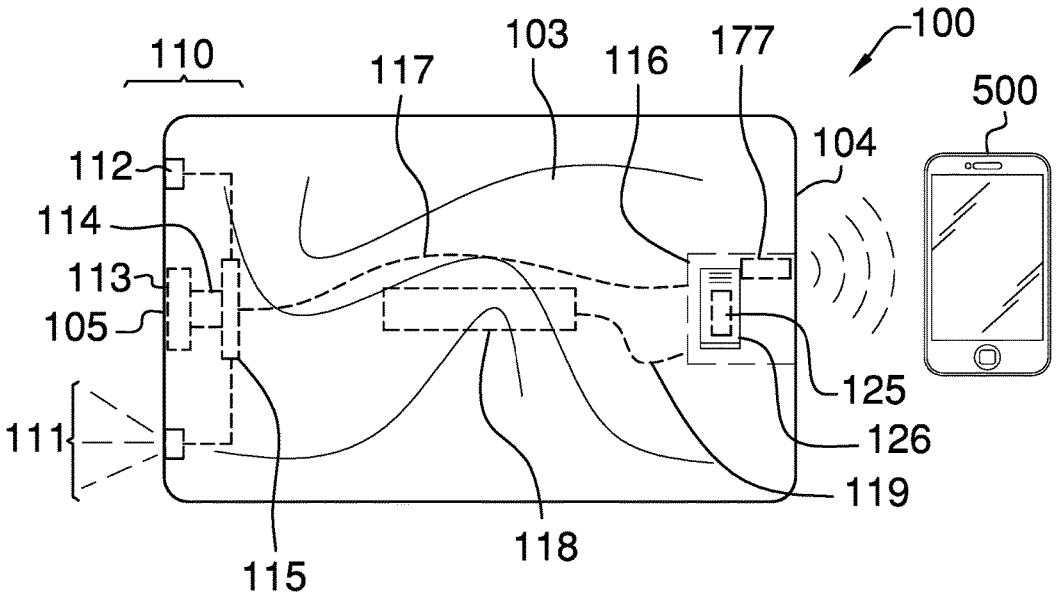
FIG. 3 is a top view of an embodiment of the disclosure.
Figure 4:
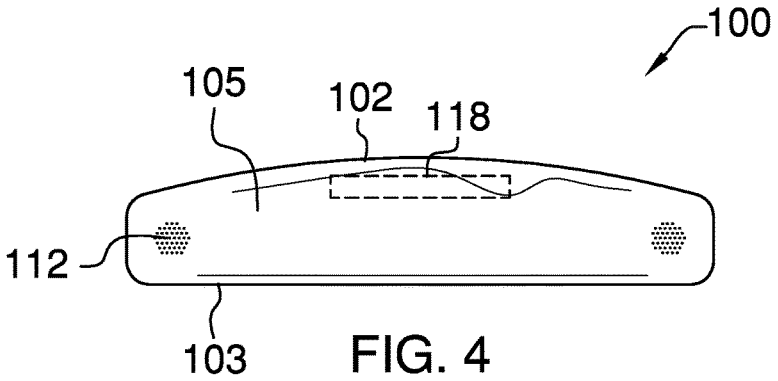
FIG. 4 is a side view of an embodiment of the disclosure.
Figure 5:
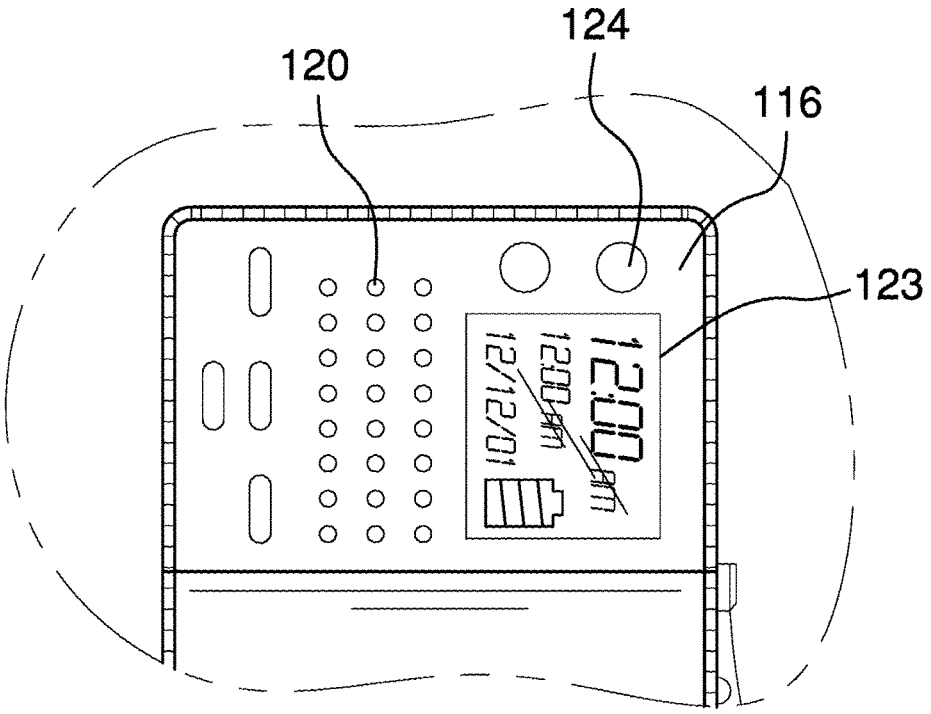
FIG. 5 is a detail of an embodiment of the disclosure.

Detailed reference will now be made to one or more potential embodiments of the disclosure, which are illustrated in FIGS. 1 through 5.

The pillow with audible and vibratory alarms 100 (hereinafter invention) comprises a pillow 101 that is further defined with a top surface 102, a bottom surface 103, a left side surface 104, and a right side surface 105. The overall size and shape of the pillow 101 is consistent with commercially available pillows.

Built into the construction of the pillow 101 is a scent distribution system 110. The scent distribution system 110 is able to dispense a fragrance 111 from at least one scent dispenser 112. The at least one scent dispenser 112 is provided on the right side surface 105. It shall be noted that the at least one scent dispenser 112 is not to be limited to any particular surface of the pillow 101, and is simply depicted as being provided on the right side surface 105.

The at least one scent dispenser 112 is further defined as a nozzle, which is in fluid connection with a reservoir 113. The reservoir 113 is located elsewhere within the pillow 101. The reservoir 113 is filled with the fragrance 111. The fragrance 111 is ideally an aqueous solution that is pumped from the reservoir 113 via a pump 114. The pump 114 is in fluid connection between the reservoir 113 and the at least one scent dispenser 112. A conduit 115 is included and provides connection between the pump 114 and the at least one scent dispenser 112.

The pump 114 is wired to a control module 116 located elsewhere with respect to the pillow 101. The pump 114 connects to the control module 116 via a pump wire 117. The control module 116 is responsible for controlling the output of the scent distribution system 110.

The control module 116 is also connected to a vibrating member 118. The vibrating member 118 is located elsewhere within the construction of the pillow 101. A vibrating wire 119 connects the vibrating member 118 to the control module 116. The vibrating member 118 is responsible for generating vibrations in order to produce a vibratory alarm when in use. The ability of the vibrating member 118 to produce a vibratory alarm is adapted to awaken an end user 200 sleeping on or adjacent to the pillow 101. It shall be noted that the scent distribution system 110 is used to generate a scent alarm.

The vibrating member 118 is well known in the art, and is a commercially available device. Most typical electronic devices, like a smart phone, include a small brushless vibration motor that when energized generates vibrations that an end user can feel. The invention 100 would incorporate this technology into the pillow 101. It shall be noted that the small brushless vibration motors of a smart phone may need to be scaled up in size or a plurality of them is required to generate the amount of vibrations needed to arouse the end user 200.

The control module 116 is also wired to a speaker 120. The speaker 120 is used to generate an audible alarm that is adapted to be able to awake the end user 200. The control module 116 and the speaker 120 are provided on the left side surface 104. The left side surface 104 includes a cover 121 that is able to seal off the control module 116 and the speaker 120. The cover 121 may include a closure member 122, such as a zipper, in order to enclose or uncover the control module 116 and the speaker 120.

The control module 116 includes a display 123 and at least one control button 124 used to provide interface between the end user 200 and the control module 116. That being said, the display 123 and the at least one control button 124 are provided adjacent to the speaker 120. The control module 116 is wired to a powering member 125 that is housed within a battery compartment 126 provided on the bottom surface 103.

In use, the control module 116 is able to generate a scent alarm via the scent distribution system 110, a vibratory alarm via the vibrating member 118, and/or an audible alarm via the speaker 120. The control module 116 is powered via the powering member 125, which in all likelihood involves the use of at least one battery. The control module 116 would likely need programming that includes a clock, timer functionality, and other programming that is typically associated with an alarm clock. This programming is well known in the art.

The left side surface 104 and the right side surface 105 are interchangeable with respect to the pillow 101. The left side surface 104 may be referred to as a first side of the pillow 101. Moreover, the right side surface 105 may be referred to as a second side of the pillow 101.

The control module 116 is optionally used to dispense an audio file via the speaker 120 that adaptively aids the end user 200 in falling asleep. The audio file would be calming, soothing, and relaxing to listen to when the pillow 101 is in use.

Optionally, the control module 116 is wired to a transceiver 177. The transceiver 177 is able to communicate wirelessly with an electronic device 500. The transceiver 177 enables the control module 116 to retrieve an audio file wirelessly such that the end user 200 is able to customize the use of the speaker 120 and the invention 100.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A pillow comprising:

wherein said pillow is able to generate a scent alarm that is adapted to awake an end user;

wherein said pillow is able to generate a vibratory alarm that is adapted to awake said end user;

wherein said pillow is able to generate an audible alarm that is adapted to awake said end user;

wherein the pillow is further defined with a top surface, a bottom surface, a left side surface, and a right side surface;

wherein the pillow includes a scent distribution system that is integrated into the construction of the pillow;

wherein the scent distribution system is able to emit a fragrance from said pillow, which acts as said scent alarm that is adapted to awake said end user;

wherein the scent distribution system is able to dispense said fragrance from at least one scent dispenser;

wherein the at least one scent dispenser is provided on either the right side surface or the left side surface of the pillow;

wherein the at least one scent dispenser is further defined as a nozzle, which is in fluid connection with a reservoir;

wherein the reservoir is located elsewhere within the pillow;

wherein the reservoir is filled with the fragrance; wherein the fragrance is pumped from the reservoir via a pump;

wherein the pump is in fluid connection between the reservoir and the at least one scent dispenser;

wherein a conduit is included and provides connection between the pump and the at least one scent dispenser;

wherein the pump is wired to a control module located elsewhere with respect to the pillow.

2. The pillow according to claim 1 wherein the pump connects to the control module via a pump wire; wherein the control module is responsible for controlling the output of the scent distribution system.

3. The pillow according to claim 2 wherein the control module is also connected to a vibrating member; wherein the vibrating member is located elsewhere within the construction of the pillow.

4. The pillow according to claim 3 wherein a vibrating wire connects the vibrating member to the control module; wherein the vibrating member is responsible for generating vibrations in order to produce said vibratory alarm.

5. The pillow according to claim 4 wherein the control module is also wired to the speaker; wherein the speaker is used to generate said audible alarm that is adapted to awake the end user.

6. The pillow according to claim 5 wherein the control module and the speaker are provided on the left side surface.

7. The pillow according to claim 6 wherein the left side surface includes a cover that is able to seal off the control module and the speaker; wherein the cover includes a closure member in order to enclose or uncover the control module and the speaker.

8. The pillow according to claim 6 wherein the control module includes a display and at least one control button used to provide interface between the end user and the control module.

9. The pillow according to claim 8 wherein the display and the at least one control button are provided adjacent to the speaker; wherein the control module is wired to a powering member that is housed within a battery compartment provided on the bottom surface.

10. The pillow according to claim 9 wherein the control module is optionally used to dispense an audio file via the speaker that adaptively aids the end user in falling asleep as opposed to an audio alarm.

11. The pillow according to claim 9 wherein the control module is wired to a transceiver; wherein the transceiver is able to communicate wirelessly with an electronic device; wherein the transceiver enables the control module to retrieve an audio file wirelessly such that the end user is able to customize the use of the pillow via the speaker.

* * * * *